US011383802B2

(12) United States Patent
Inoue

(10) Patent No.: US 11,383,802 B2
(45) Date of Patent: Jul. 12, 2022

(54) TRIM TAB CONTROL SYSTEM FOR A SHIP AND A SHIP WITH THE TRIM TAB CONTROL SYSTEM

(71) Applicant: YAMAHA HATSUDOKI KABUSHIKI KAISHA, Iwata (JP)

(72) Inventor: Hiroshi Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 356 days.

(21) Appl. No.: 16/845,116

(22) Filed: Apr. 10, 2020

(65) Prior Publication Data

US 2020/0331572 A1 Oct. 22, 2020

(30) Foreign Application Priority Data

Apr. 16, 2019 (JP) ..... JP2019-077955

(51) Int. Cl.
*B63B 79/40* (2020.01)
*B63B 79/10* (2020.01)
*B63B 39/06* (2006.01)

(52) U.S. Cl.
CPC ..... *B63B 79/40* (2020.01); *B63B 39/061* (2013.01); *B63B 79/10* (2020.01)

(58) Field of Classification Search
CPC ..... B63B 79/00; B63B 79/40; B63B 39/06; B63B 39/061; B63B 1/20; B63B 1/21
USPC ..... 114/278, 280, 285; 701/21
See application file for complete search history.

(56) References Cited

U.S. PATENT DOCUMENTS

| | | | | |
|---|---|---|---|---|
| 5,385,110 | A * | 1/1995 | Bennett | B63B 39/061 114/286 |
| 6,273,771 | B1 * | 8/2001 | Buckley | B63H 21/213 114/144 RE |
| 7,311,058 | B1 * | 12/2007 | Brooks | B63B 79/10 114/285 |
| 8,376,793 | B2 * | 2/2013 | Chiecchi | B63H 5/125 440/53 |
| 8,480,445 | B2 * | 7/2013 | Morvillo | B63H 25/04 440/40 |
| 8,707,884 | B2 * | 4/2014 | Snow | B63B 39/061 114/285 |
| 9,156,372 | B1 * | 10/2015 | Guglielmo | B63B 34/70 |
| 9,278,740 | B1 * | 3/2016 | Andrasko | G05D 1/0875 |
| 9,745,020 | B2 * | 8/2017 | Snow | B63B 39/061 |
| 9,891,620 | B2 * | 2/2018 | Green | G05D 1/0875 |
| 10,040,522 | B1 * | 8/2018 | Hartman | B63B 34/75 |
| 10,386,834 | B2 * | 8/2019 | Green | B63B 34/75 |
| 11,067,979 | B2 * | 7/2021 | Green | B63B 34/75 |

FOREIGN PATENT DOCUMENTS

JP 2009-262588 A 11/2009

* cited by examiner

*Primary Examiner* — Daniel V Venne
(74) *Attorney, Agent, or Firm* — Keating and Bennett, LLP

(57) ABSTRACT

A trim tab control system for a ship includes a trim tab and a controller. The trim tab is able to swing on a ship body. The controller is configured or programmed to swing the trim tab at a first swing speed when the trim tab is not at a time of landing based on operation state data indicating the operation state of the ship. The controller is configured or programmed to swing the trim tab at a second swing speed less than the first swing speed when the trim tab is at the time of landing based on the operation state data.

21 Claims, 15 Drawing Sheets

TRIM TAB CONTROL SYSTEM FOR A SHIP AND A SHIP WITH THE TRIM TAB CONTROL SYSTEM

CROSS REFERENCE TO RELATED APPLICATIONS

This application claims the benefit of priority to Japanese Patent Application No. 2019-077955 filed Apr. 16, 2019. The entire contents of this application are hereby incorporated herein by reference.

BACKGROUND OF THE INVENTION

1. Field of the Invention

The present invention relates to a trim tab control system for a ship and a ship with the trim tab control system.

2. Description of the Related Art

The prior art discloses a configuration in which a trim tab is attached to a rear portion of a ship body. For example, in Japanese Patent Application Laid-Open No. 2009-262588, a trim tab is swingably attached to the rear portion of the ship body. The trim tab generates a lifting force on the ship body by swinging from the ship body toward a water surface and landing on the water surface.

Generally, in the prior art, the trim tab swings at a constant swing speed from the ship body toward the surface of the water surface and lands on the water surface. In this case, when the trim tab lands on the water surface, there is a possibility that the ship attitude changes by the resistance acting on the trim tab. In other words, the attitude of the ship body may change to an attitude different from the attitude intended by the designer during operation of the trim tab in the prior art.

SUMMARY OF THE INVENTION

In view of the above-described problems, preferred embodiments of the present invention provide trim tab control systems for ships and ships including the trim tab control systems, each of which is able to stably change a ship attitude during operation of the trim tab.

A trim tab control system according to a preferred embodiment of the present invention includes a trim tab and a controller. The trim tab is swingable on a ship body. The controller is configured or programmed to swing the trim tab at the first swing speed when the trim tab is not at the time of landing on the water based on the operation state data indicating the operation state of the ship. The controller is configured or programmed to swing the trim tab at a second swing speed less than the first swing speed when the trim tab is at the time of landing based on the operation state data.

According to preferred embodiments of the present invention, it is possible to stably change a ship attitude during operation of the trim tab in a trim tab control system for the ship.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
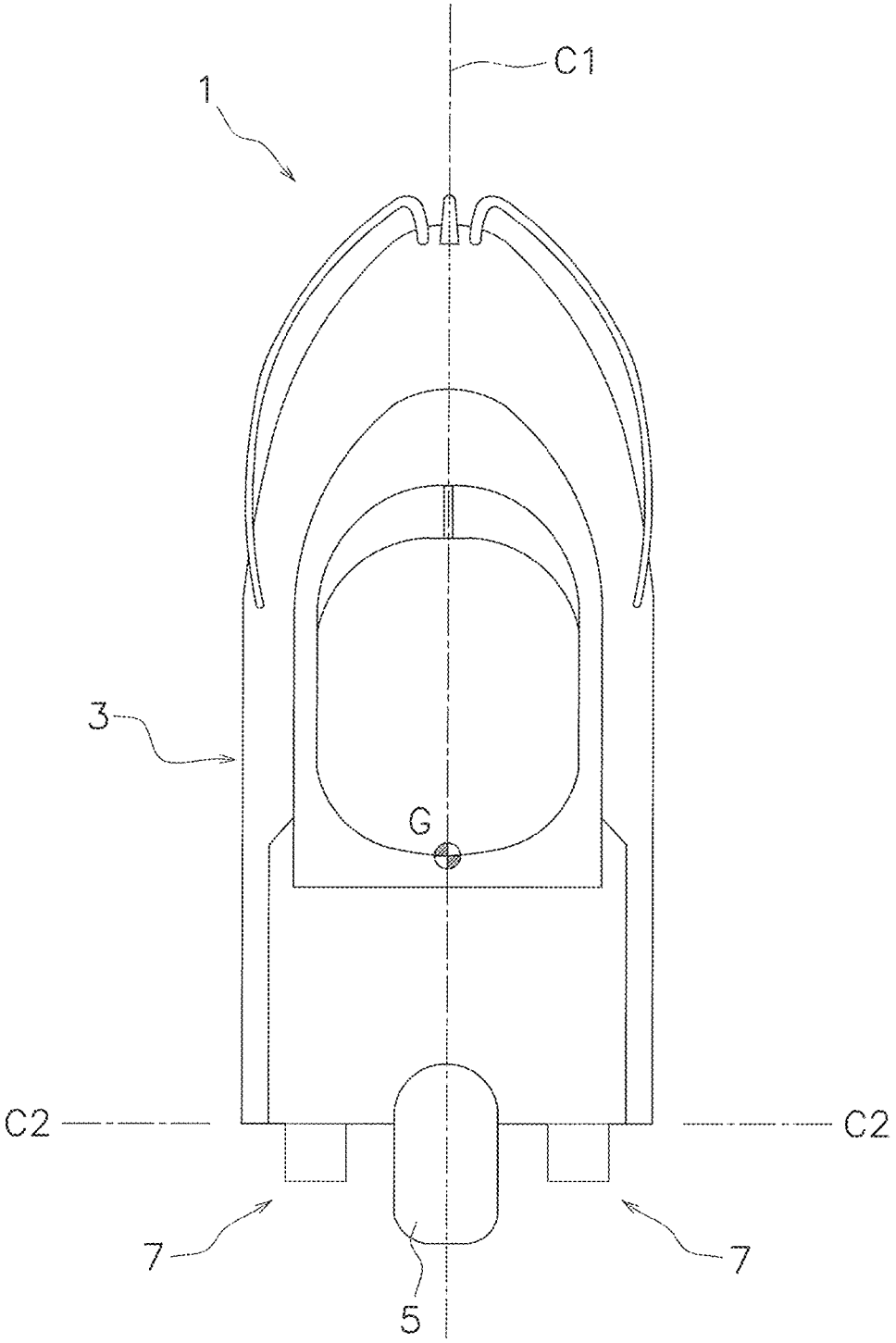
FIG. 1 is a top view of a ship according to a preferred embodiment of the present invention.

Hereinafter, preferred embodiments will be described with reference to the drawings. The ship 1 includes a ship body 3 and at least one trim tab 7. Specifically, the ship 1 includes a ship body 3, a propulsion device 5, and a plurality of trim tabs 7 (for example, a pair of trim tabs 7). The ship 1 includes a trim tab control system 31.

An example in which one propulsion device 5 is provided is illustrated, but a plurality of propulsion devices 5 may be provided. Further, the number of trim tabs 7 may be one or three or more.

In the following description, the front, rear, left, right, up, and down directions mean the front, rear, left, right, up, and down directions of the ship body 3, respectively. For example, as shown in FIG. 1, a center line C1 extending in the front-rear direction of the ship body 3 passes through the center of gravity G of the ship body 3. The front-back direction extends along the center line C1. The forward direction extends upward along the center line C1 in FIG. 1. The rear direction extends downward along the center line C1 in FIG. 1.

The left-right direction (the width direction) is perpendicular to the center line C1 in FIG. 1. The left direction is perpendicular to the center line C1 and on a left side of the center line C1 in FIG. 1. The right direction is perpendicular to the center line C1 and on a right side of the center line C1 in FIG. 1. The vertical direction is perpendicular to the front-rear direction and the left-right direction.

Figure 2:
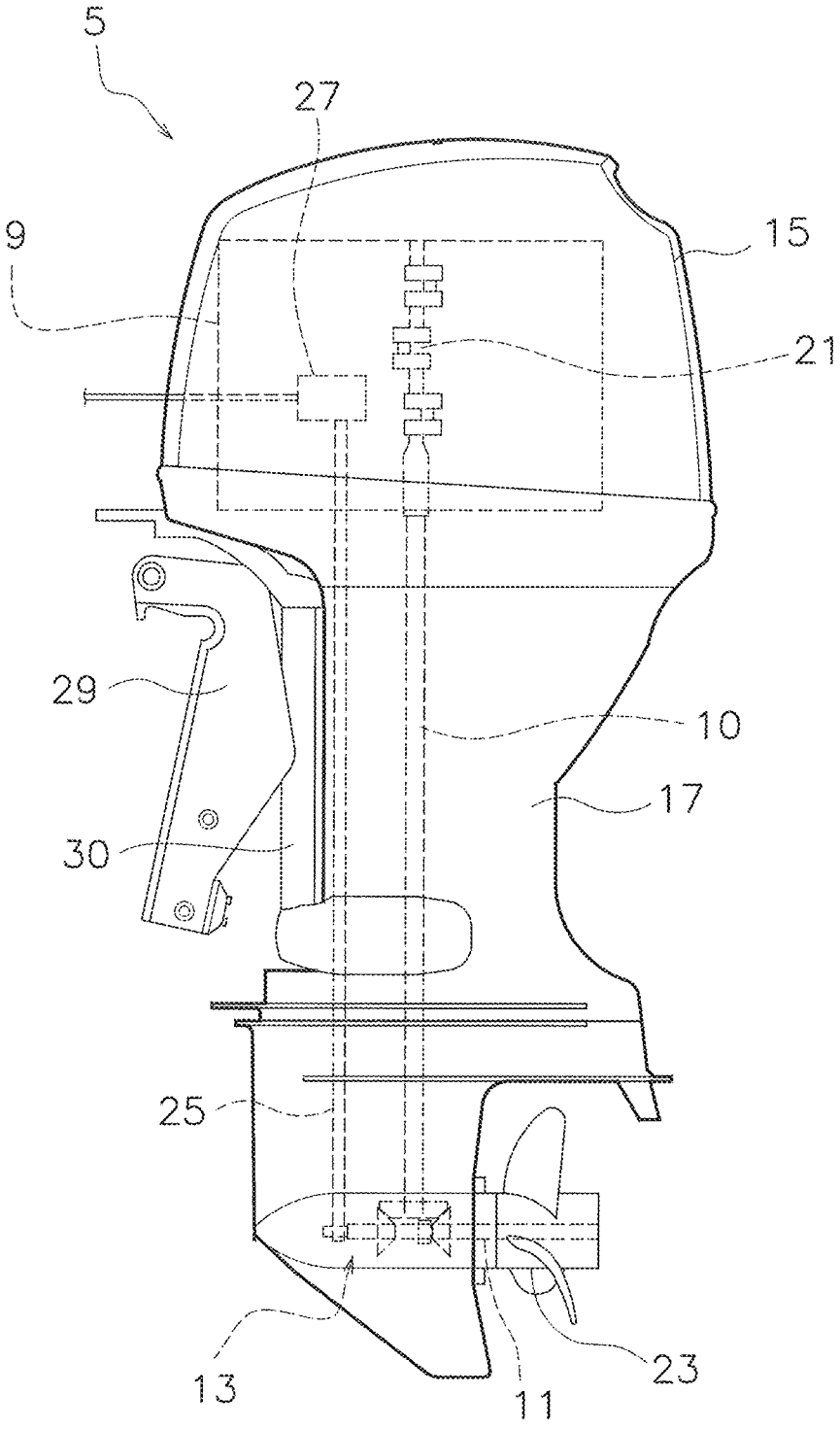
FIG. 2 is a side view of a propulsion device.

As shown in FIG. 2, the propulsion device 5 is, for example, an outboard motor. The propulsion device 5 generates a thrust to propel the ship body 3. The propulsion device 5 is attached to the stern of the ship body 3. For example, the propulsion device 5 is disposed between the pair of trim tabs 7.

The propulsion device 5 includes an engine 9, a drive shaft 10, a propeller shaft 11, a shift mechanism 13, an engine cover 15, a housing 17, and a bracket 29.

The engine 9 applies the thrust to the ship body 3. The engine 9 is a power source to generate the thrust of the ship body 3. In the present preferred embodiment, an example in which the engine 9 is used as the power source is illustrated, but a motor may be used as the power source. The engine 9 is disposed inside the engine cover 15. The engine 9 includes a crankshaft 21. The crankshaft 21 extends in the vertical direction.

The drive shaft 10 is connected to a crankshaft 21. The drive shaft 10 extends downward from engine 9. The propeller shaft 11 extends in a direction intersecting the drive shaft 10. The propeller shaft 11 extends in the front-rear direction. The propeller shaft 11 is connected to the drive shaft 10 via the shift mechanism 13. A propeller 23 is connected to the propeller shaft 11.

The housing 17 is disposed below the engine cover 15. The drive shaft 10, the propeller shaft 11, and the shift mechanism 13 are disposed in the housing 17. The shift mechanism 13 is driven by a shift actuator 27 via a shift member 25. The shift mechanism 13 switches the rotation direction of the power transmitted from the drive shaft 11 to the propeller shaft 12. Thus, the rotation direction of the propeller 23 is switched to the forward direction or the reverse direction.

The bracket 29 is used to attach the propulsion device 5 to the ship body 3. The propulsion device 5 is detachably fixed to the stern of the ship body 3 via the bracket 29. The bracket 29 includes a steering shaft 30. The propulsion device 5 is supported by a bracket 29 so as to be rotatable around the steering shaft 30.

As shown in FIG. 1, the pair of trim tabs 7 are attached to the stern of the ship body 3. For example, each of the pair of trim tabs 7 is swingably attached to the stern of the ship body 3. Specifically, the pair of trim tabs 7 are swingably attached to the stern of the ship body 3 on the left and right sides of the propulsion device 5. Each of the pair of trim tabs 7 is attached to the stern of the ship body 3 so as to be swingable around a swing axis C2.

Figure 3:
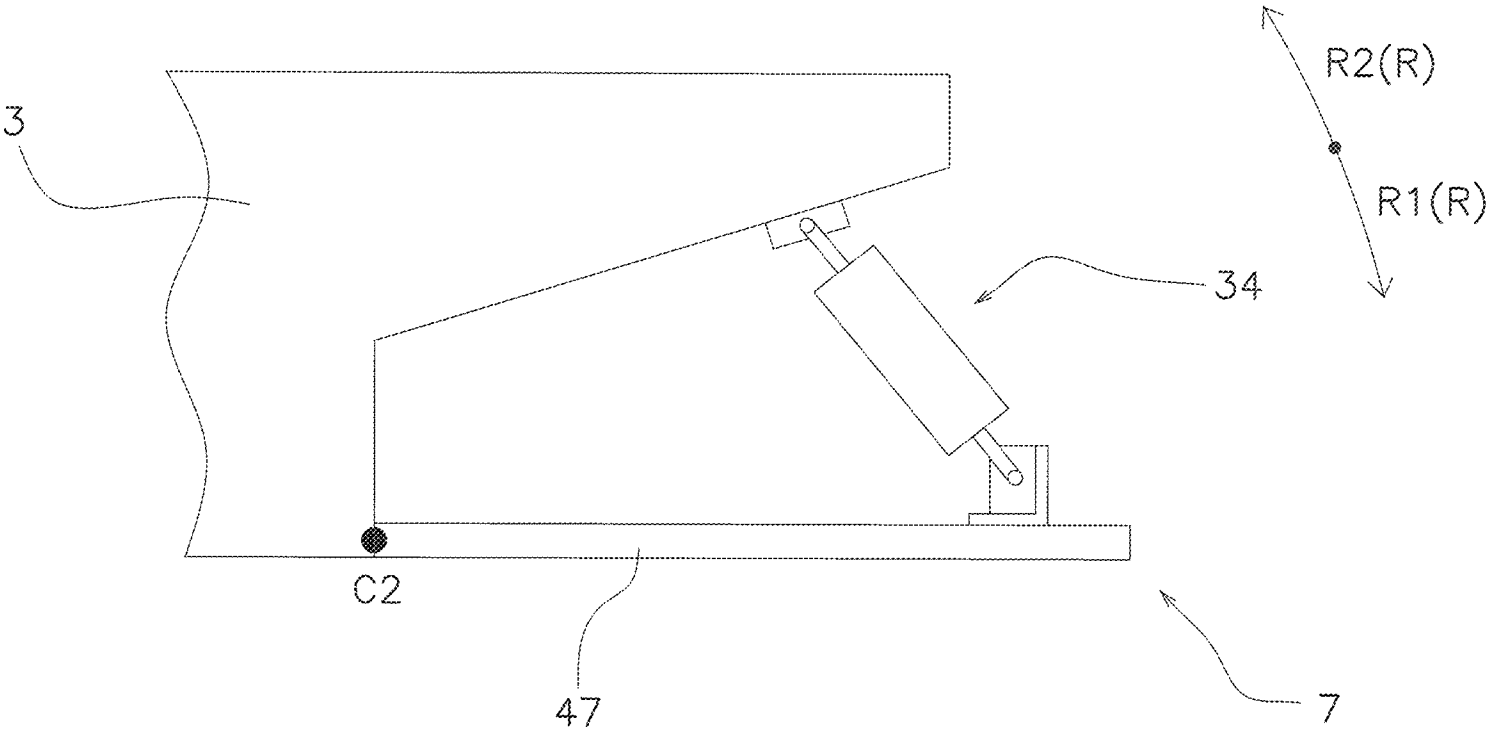
FIG. 3 is a side view of a trim tab attached to a ship body.

As shown in FIG. 3, each of the trim tabs 7 includes a trim actuator 34 and a tab body 47.

The trim actuators 34 are used to swing the tab bodies 47 with respect to the ship body 3. The trim actuators 34 are attached to the tab bodies 47 between the tab bodies 47 and the ship body 3.

Each of the tab bodies 47 is swingably attached to the stern of the ship body 3. For example, the base end of each of the tab bodies 47 is attached to the stern of the ship body 3 so as to swing around the swing axis C2. When each of the trim actuators 34 operates, each of the tab bodies 47 swings in a swing direction R.

As shown in FIG. 3, the swing direction R is defined based on the swing axis C2. In the present preferred embodiment, the swing axis C2 extends in a direction perpendicular or substantially perpendicular to the center line C1. For example, the swing axis C2 extends in the left-right direction. The swing axis C2 may extend obliquely so as to intersect the steering shaft 30.

Hereinafter, when each of the tab bodies 47 swings in a direction away from the ship body 3, for example, when each of the tab bodies 47 swings from the ship body 3 toward the water surface, the swing direction R of each of the tab bodies 47 is described as a first swing direction R1.

When each of the tab bodies 47 swings in a direction approaching the ship body 3, for example, when each of the tab bodies 47 swings from the water surface (underwater) toward the ship body 3, the swing direction R of each of the tab bodies 47 is described as a second swing direction R2. The "swing direction R" broadly includes the first swing direction R1 and the second swing direction R2.

Figure 4:
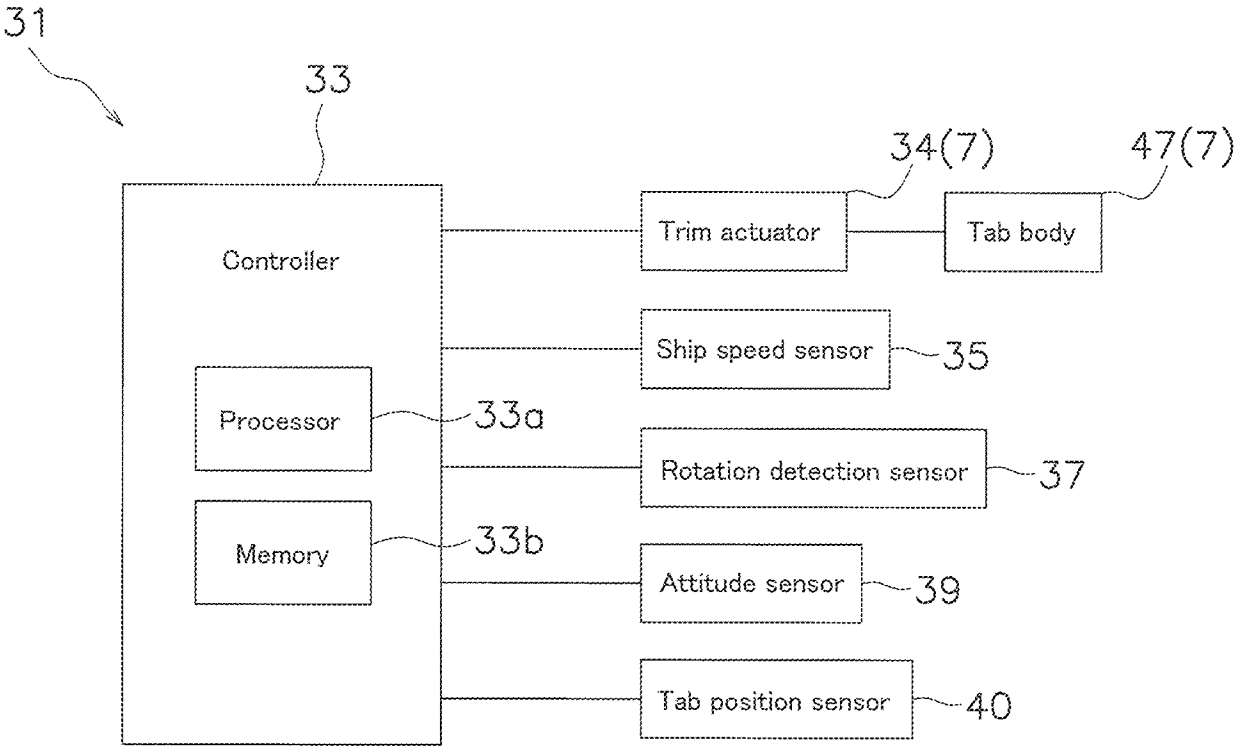
FIG. 4 is a schematic diagram showing a configuration of the trim tab control system.

The ship 1 is equipped with a trim tab control system 31. As shown in FIG. 4, the trim tab control system 31 includes the trim tabs 7 and a controller 33. The trim tab control system 31 includes a ship speed sensor 35, a rotation detection sensor 37, and an attitude sensor 39.

Each of the trim tabs 7 includes the trim actuator 34 and the tab body 47 as described above. Each of the trim actuators 34 is controlled by the controller 33. Each of the tab bodies 47 swings due to the operation of each of the trim actuators 34. Each of the trim actuators 34 may be a hydraulic actuator or an electric actuator.

The operation amount data corresponding to the operation amount of the trim actuator 34 is stored in a memory 33*b* (described below) during the operation of the trim actuator 34. For example, when the trim actuator 34 is the hydraulic actuator, the operation amount data corresponding to the operation amount of a piston is stored in the memory 33*b*. When the trim actuator 34 is the electric actuator, the operation amount data corresponding to the operation amount of the rod and/or the rotation amount of the motor is stored in the memory 33*b*.

The controller 33 includes a processor 33*a* and a memory 33*b*. The processor 33*a* includes, for example, a CPU (Central Processing Unit). The processor 33*a* executes processes to control each device and each sensor based on a program stored in the memory 33*b*. For example, the processor 33*a* executes the process to control each of the trim actuators 34 based on the program stored in the memory 33*b*. The description of "the process executed by the controller 33" may be interpreted as "the process executed by the processor 33*a*".

The memory 33*b* includes a volatile memory such as a RAM. The memory 33*b* includes a nonvolatile memory such as a ROM. The memory 33*b* stores programs and data to control each device and each sensor. For example, the memory 33*b* stores programs and data to control each of the trim actuators 34.

The controller 33 may include an auxiliary storage device such as a hard disk and/or an SSD. Further, an external storage device (not shown) such as a hard disk and/or an SSD (not shown) may be connected to the controller 33.

For example, the memory 33*b* stores operation state data indicating the operation state of the ship 1. Specifically, the memory 33*b* stores the operation state data as time-series data. The operation state data includes at least one of ship speed data indicating the speed of the ship body 3, attitude data indicating an attitude of the ship body 3, and rotation speed data indicating the rotation speed of the engine 9. In the present preferred embodiment, an example is shown in which the operation state data includes the ship speed data, the attitude data, and the rotation speed data.

The operation state data further includes tab position data indicating the position of the tab body 47 with respect to the ship body 3. The tab position data is detected by a tab position sensor 40 (see FIG. 4). The tab position sensor 40 is mounted on the ship body 3. Specifically, the tab position sensor 40 is mounted on the ship body 3 so as to face the tab body 47.

The tab position data is able to be calculated by the controller 33 based on the operation amount data of the trim actuator 34. The tab position sensor 40 outputs the tab position data indicating the position of the tab body 47 to the controller 33.

The operation state data may include a first swing speed V1 (described below) of the tab body 47.

The memory 33*b* stores landing determination data to set the time of landing before the tab body 47 lands on the water. The landing determination data indicates a correspondence relationship between the first condition data (the ship speed data, the rotation speed data, the attitude data, and the tab position data) and the time of landing. For example, the landing determination data includes data such as table data and map data and the like.

For example, a flag corresponding to the first condition data is defined in the landing determination data. The flag includes a first flag (for example, 0) indicating that the tab body 47 is not at the time of landing, and a second flag (for example, 1) indicating that the tab body 47 is at the time of landing.

The first flag or the second flag is determined by comparing the operation state data (the ship speed data, the rotation speed data, the attitude data, and the tab position data) acquired by the controller 33 with the first condition data (the ship speed data, the rotation speed data, the attitude data, and the tab position data) of the landing determination data.

The memory 33*b* stores speed setting data to set a second swing speed V2 (described below) of the tab body 47. The speed setting data indicates the correspondence relationship between the second condition data (the ship speed data, the rotation speed data, the attitude data, the tab position data), and the second swing speed V2 of the tab body 47. For example, the speed setting data includes data such as table data and map data and the like.

The second swing speed V2 of the tab body 47 is determined by comparing the operation state data (the ship speed data, the rotation speed data, the attitude data, and the tab position data) acquired by the controller 33 with the second condition data (the ship speed data, the rotation speed data, the attitude data, the tab position data) in the speed setting data) of the speed setting data.

The memory 33*b* stores first table data indicating the relationship between the attitude data and a target tab position of each of the tab bodies 47. The first table data is used to set the target tab position to adjust the ship attitude of the ship 1.

The memory 33*b* stores the swing speed of each of the tab bodies 47 which is set based on the landing determination data. The swing speed V includes the first swing speed V1 and the second swing speed V2 that is less than the first swing speed V1 (see FIG. 5C). Preferably, the first swing speed V1 and the second swing speed V2 are set based on the operation state data (the ship speed data, the attitude data, the rotation speed data, the tab position data).

Specifically, the first swing speed V1 and the second swing speed V2 are preferably changed based on at least one of the ship speed of the ship body 3, the ship attitude of the ship body 3, the rotation speed of the engine 9, and the tab position of the tab body 47. Each of the first swing speed V1 and the second swing speed V2 may be interpreted as an average swing speed of the tab body 47.

The memory 33*b* stores a threshold to determine when the tab body 47 lands on the water. The threshold is preferably set based on the operation state data (the ship speed data, the attitude data, the rotation speed data, the tab position data). Specifically, the threshold is preferably set to a predetermined value for each of the ship speed of the ship body 3, the ship attitude of the ship body 3, and the rotation speed of the engine 9.

In this case, the memory 33*b* stores second table data indicating the relationship between the operation state data (the ship speed data, the attitude data, the rotation speed data, the tab position data) and the threshold. The second table data defines thresholds respectively corresponding to the ship speed data, the attitude data, the rotation speed data, and the tab position data.

The ship speed sensor 35 detects the ship speed data indicating the ship speed of the ship body 3. The ship speed sensor 35 is attached to the ship body 3. For example, the ship speed sensor 35 includes a GPS receiving unit. The ship speed sensor 35 receives time series data of a ship body position from a GPS satellite. GPS is an abbreviation of Global Positioning System.

The GPS receiving unit calculates the ship speed data with the time series data of the ship body position and outputs the ship speed data to the controller 33. The ship speed data is stored in the memory 33*b*. The GPS receiving unit is able to output the time series data of the ship body position to the controller 33 and the controller 33 is able to calculate the ship speed data based on the time series data of the ship body position.

The rotation detection sensor 37 detects the rotation speed data indicating the rotation speed of the engine 9. For example, the rotation detection sensor 37 detects the rotation speed data indicating the rotation speed of the crankshaft 21. The rotation detection sensor 37 is attached to the engine so as to face the crankshaft 21. The rotation detection sensor 37 outputs rotation number data to the controller 33. The rotation speed data is stored in the memory 33*b* as time-series data. The rotation detection sensor 37 may include a sensor such as an electromagnetic sensor and an optical sensor and the like.

The attitude sensor 39 detects the attitude data indicating the ship attitude of the ship body 3. The attitude sensor 39 is attached to the ship body 3. For example, the attitude sensor 39 includes a gyro sensor. The attitude data includes roll data around a roll axis, pitch data around a pitch axis, and yaw data around a yaw axis. The attitude sensor 39 outputs the attitude data to the controller 33. The attitude data is stored in the memory 33*b* as time-series data. The attitude sensor 39 may be another sensor such as an acceleration sensor.

The controller 33 operates each of the tab bodies 47 by controlling each of the trim actuators 34. For example, the controller 33 sets the swing speed V of each of the tab bodies 47 by controlling each of the trim actuators 34. The swing speed V includes the first swing speed V1 and the second swing speed V2. The controller 33 sets the first swing speed V1 to a predetermined swing speed stored in the memory 33*b*.

The controller 33 preferably sets the second swing speed V2 such that an elapsed time from when the tab body 47 lands on the water and the water pressure acting on the tab body 47 are in a proportional relationship. Specifically, the controller 33 preferably sets the second swing speed V2 so that the elapsed time elapsed from when the tab body 47 lands on the water and the vertical force acting on the tab body 47 are in a proportional relationship. The vertical force may be a substantially vertical force.

In this case, the controller 33 sets the second swing speed V2 based on the operation state data (the attitude data, the ship speed data, the tab position data). Specifically, the controller 33 sets the second swing speed V2 corresponding to the operation state data (the attitude data, the ship speed data, the tab position data) based on the speed setting data.

In the present preferred embodiment, the controller 33 sets the second swing speed V2 based on the operation state data (the ship speed data, the rotation speed data, the attitude data, the tab position data). In this case, the controller 33 sets the second swing speed V2 corresponding to the operation state data (the ship speed data, the rotation speed data, the attitude data, the tab position data) based on the speed setting data.

In the speed setting data, the second swing speed V2 is defined so that the elapsed time from when the tab body 47 lands on the water and the water pressure acting on the tab body 47 are in a proportional relationship.

The controller 33 determines the current position of the tab body 47 with respect to the ship body 3 based on the tab position data. The controller 33 is able to determine the current position of the tab body 47 with respect to the ship body 3 based on the tab position data. In this case, the controller 33 calculates the current tab position data of the tab body 47 based on the tab position data. The controller 33 determines the current position of the tab body 47 based on the tab position data.

The controller 33 acquires the attitude data from the attitude sensor 39. The controller 33 operates each of the trim actuators 34 based on the attitude data. For example, the controller 33 sets the target tab position of each of the tab bodies 47 based on the attitude data. The controller 33 operates each of the trim actuators 34 toward the target tab position.

In the present preferred embodiment, the tab position is set to a reference tab position, for example, 0 (degree), when the tip of the tab body 47 is located at the uppermost position. The target tab position is set based on the reference tab position. The "tab position" and "target tab position" may be interpreted as "the tab position data" and "target tab angle".

The controller 33 acquires the ship speed data from the ship speed sensor 35. The controller 33 acquires the attitude data from the attitude sensor 39. The controller 33 acquires the rotation speed data from the rotation detection sensor 37. The controller 33 acquires the tab position data.

The controller 33 operates each of the trim actuators 34 based on the ship speed data, the attitude data, the rotation speed data, and the tab position data. For example, the controller 33 determines the flag (the first flag or the second flag) corresponding to the ship speed data, the attitude data, the rotation speed data, and the tab position data based on the landing determination data.

When the controller 33 determines the first flag is set, the controller 33 swings each of the tab bodies 47 at the first swing speed V1. Specifically, the controller 33 operates each of the trim actuators 34 such that each of the tab bodies 47 swings at the first swing speed V1.

When the controller 33 determines the second flag is set, the controller 33 swings each of the tab bodies 47 at the second swing speed V2. For example, the controller 33 swings each of the tab bodies 47 at the second swing speed in a predetermined time range including the time when the tab bodies 47 lands on the water. Specifically, when the controller 33 determines the second flag is set, the controller 33 operates each of the trim actuators 34 such that each of the tab bodies 47 swings at the second swing speed V2 in the above-described predetermined time range.

When at least one of the pair of tab bodies 47 swings toward the water in order to adjust the ship attitude of the ship body 3, the controller 33 sets the time of landing of the tab body 47 based on the operation state data before the tab body 47 lands on the water.

For example, when the controller 33 causes the tab body 47 to swing toward the water, the controller 33 estimates the time of landing of the tab body 47 based on at least one of the ship speed data, the rotation speed data, the attitude data, and the tab position data.

Here, the controller 33 estimates the time of landing of the tab body 47 based on the ship speed data, the rotation speed data, the attitude data, and the tab position data. For example, the controller 33 sets the time of landing of the tab body 47 based on the landing determination data (table data or map data) stored in the memory 33*b*.

The controller 33 refers to the landing determination data. The controller 33 determines that the tab body 47 is at the time of landing when the flag corresponding to the rotation speed data, the attitude data, and the tab position data is the first flag. The controller 33 determines that the tab body 47 is not at the time of landing when the flag corresponding to the rotation speed data, the attitude data, and the tab position data is the second flag.

When at least one of the pair of tab bodies 47 swings toward the water in order to adjust the ship attitude of the ship body 3, the controller 33 determines the landing of the ship body 3 based on the operation state data. For example, when the controller 33 causes the tab body 47 to swing toward the water, the controller 33 determines the landing of the ship body 3 based on at least one of the ship speed data, the rotation speed data, the attitude data, and the tab position data.

Figure 5A:
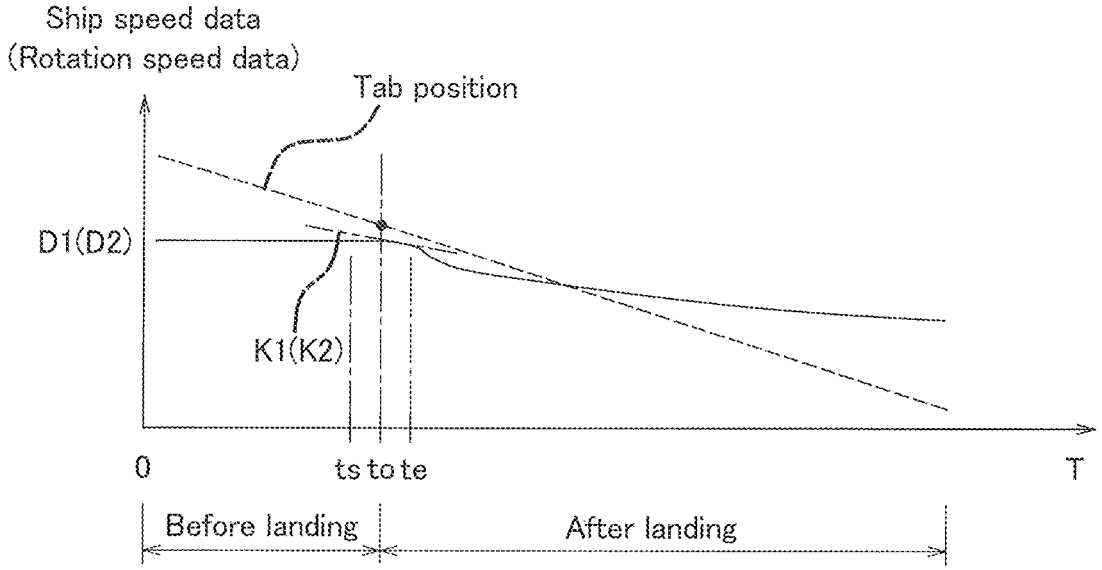
FIG. 5A is a figure for explaining the change of the operation state data at the time of landing of the tab body.
Figure 5B:
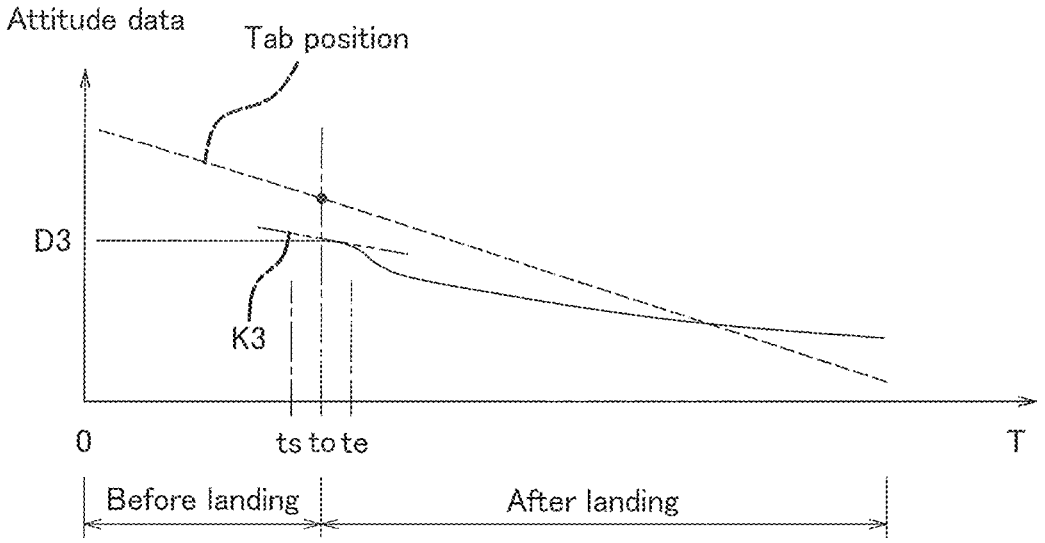
FIG. 5B is a figure for explaining the change of the operation state data at the time of landing of the tab body.

Specifically, as shown in FIGS. 5A and 5B, each of the ship speed data, the rotation speed data, and the attitude data changes before and after the landing of the tab body 47. FIGS. 5A and 5B show an example in which the tab body 47 lands on the water in a state where the ship speed is constant, for ease of explanation. The landing time of the tab body 47 is described as "to" in FIGS. 5A and 5B.

For example, as shown in FIG. 5A, the ship speed data is stable at the first data value D1 until the tab body 47 lands on the water ($T<to$). After the tab body 47 lands on the water ($T\geq to$), for example, immediately after the tab body 47 lands on the water, the ship speed data decreases from the first data value D1. In other words, the ship speed data greatly changes before and after the first data value D1.

Similarly, the rotation speed data is stable at the second data value D2 until the tab body 47 lands on the water ($T<to$). After the tab body 47 lands ($T\geq to$), for example, immediately after the tab body 47 lands on the water, the rotation speed data decreases from the second data value D2. In other words, the rotation speed data greatly changes before and after the second data value D2.

Similarly, as shown in FIG. 5B, the attitude data is stable at the third data value D3 until the tab body 47 lands on the water ($T<to$). After the tab body 47 lands on the water ($T\geq to$), for example, immediately after the tab body 47 lands on the water, the attitude data decreases from the third data value D3. In other words, the attitude data greatly changes before and after the third data value D3.

Thus, amount of change of the operation state data (the ship speed data, the rotation speed data, the attitude data) differs before and after the landing of the tab body 47.

Therefore, the controller 33 is able to determine the time of landing of the tab body 47 by monitoring the amount of change of the operation state data by the controller 33.

Further, the controller 33 is able to determine the time of landing of the tab body 47 by assuming that the tab body 47 lands on the water when the tab position (the current tab position) of the tab body 47 is at the predetermined tab position.

The controller 33 calculates the amount of change of the operation state data based on the time series data of the operation state data (the ship speed data, the rotation speed data, the attitude data).

For example, the absolute values |K1|, |K2|, |K3| of the inclinations K1, K2, K3 of the operation state data are used as the amounts of change of the operation state data respectively. The inclinations K1, K2, K3 of the operation state data are calculated based on the time-series data of the operation state data shown in FIGS. 5A and 5B.

As shown in FIGS. 5A and 5B, the amount of change of the operation state data is evaluated by the absolute values, since the inclinations K1, K2, and K3 of the operation state data have negative inclinations.

Here, an average value of the amounts of change |K1|, |K2|, |K3| of the operation state data in a predetermined time range is preferably used as the amount of change |K1|, |K2|, |K3| of the operation state data.

For example, there is a possibility that the tab body 47 instantaneously lands on the water due to a change of the water surface state. In this case, the controller 33 may determine that the tab body 47 lands on the water. However, the controller 33 is able to appropriately estimate the time of landing by using the average value of the amounts of change |K1|, |K2|, |K3| of the operation state data as the amount of change of the operation state data.

The controller 33 sets a threshold based on the operation state data. For example, the controller 33 sets a threshold corresponding to the operation state data (the ship speed data, the attitude data, the rotation speed data, the tab position data) based on the second table data.

The controller 33 preferably changes the threshold according to the ship speed of the ship 1 and the rotation speed of the engine 9 based on the second table data. For example, the controller 33 preferably changes the threshold according to the first data value D1 of the ship speed data and/or the second data value D2 of the rotation speed data shown in FIG. 5A. The controller 33 is able to change the threshold according to the third data value D3 of the attitude data shown in FIG. 5B.

Further, the controller 33 preferably changes the threshold according to the tab position of the tab body 47 based on the second table data. As shown in FIGS. 5A and 5B, the time of landing of the tab body 47 may be estimated based on the tab position. The time of landing corresponding to the tab position, for example, the deceleration start time (ts) and the landing time (to) is defined in the second table data.

The controller 33 determines the time of landing of the tab body 47 based on the amounts of change |K1|, |K2|, |K3| of the operation state data. For example, the controller 33 determines that the tab body 47 does not land on the water when the amounts of change |K1|, |K2|, |K3| of the operation state data are less than the threshold. When the amounts of change |K1|, |K2|, |K3| of the operation state data are equal to or greater than the threshold, the controller 33 determines that the tab body 47 lands on the water.

The amount of change of the operation state data is at least one of the amount of change |K1| of the ship speed data, the amount of change |K2| of the rotation speed data, and the amount of change |K3| of the attitude data.

Figure 6A:
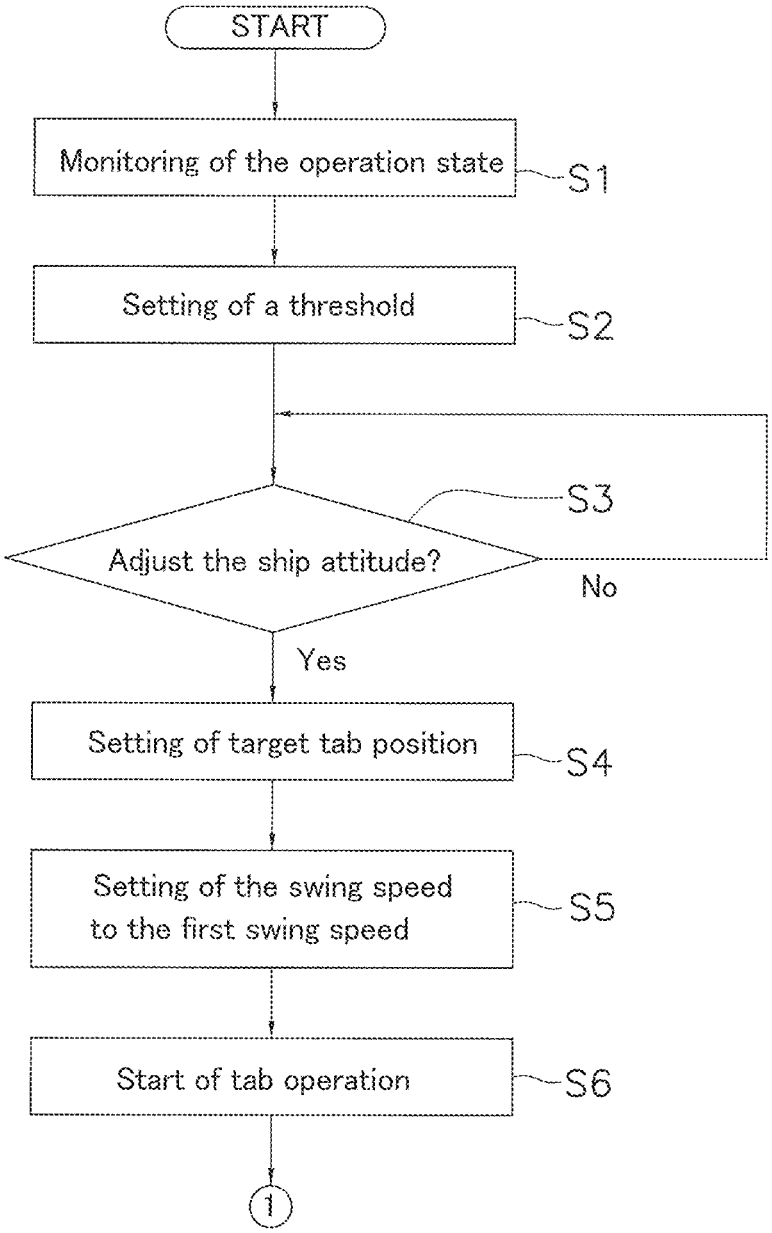
FIG. 6A is a flowchart showing processes performed by a trim tab control system.
Figure 6B:
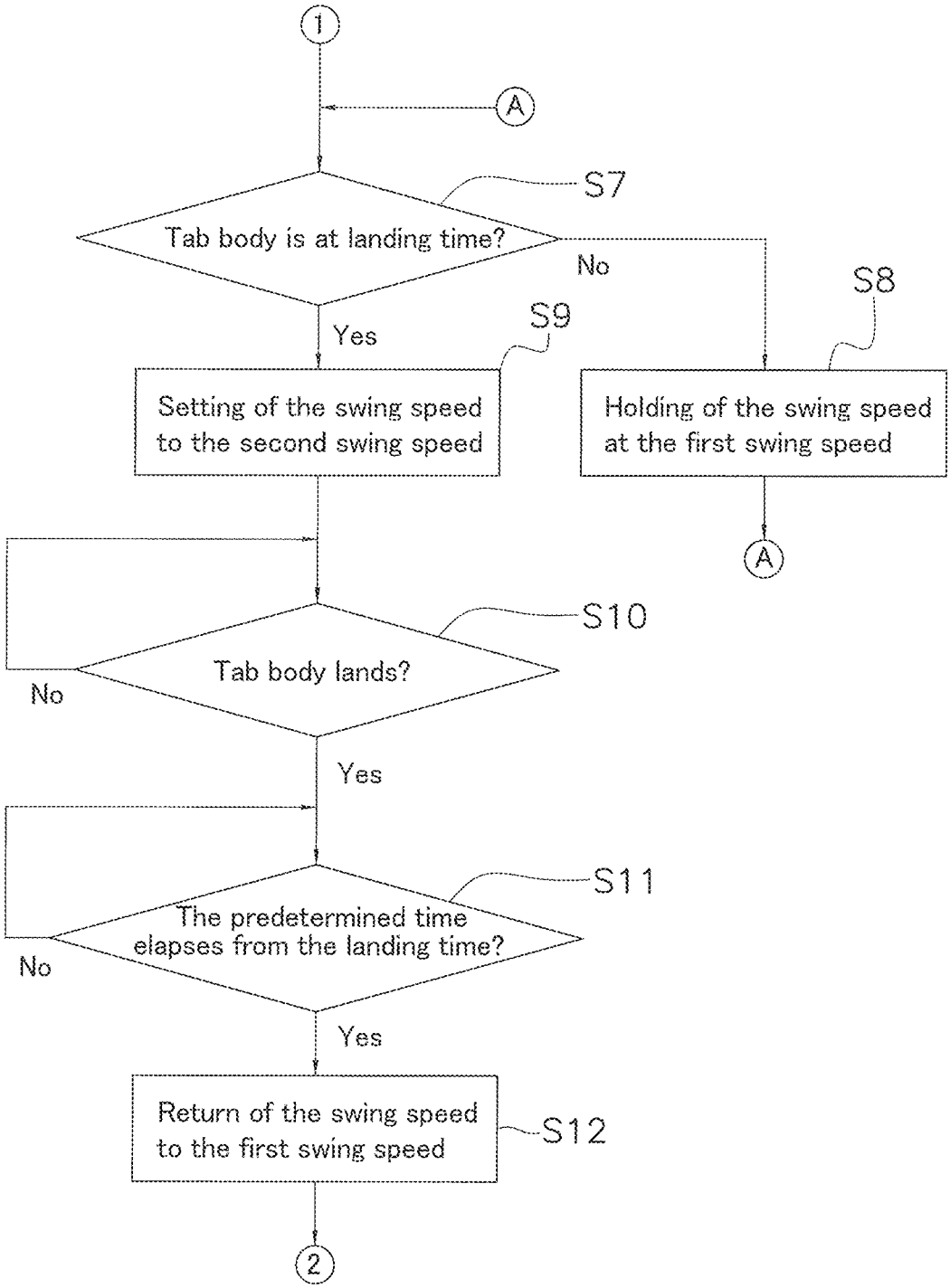
FIG. 6B is a flowchart showing processes performed by a trim tab control system.
Figure 6C:
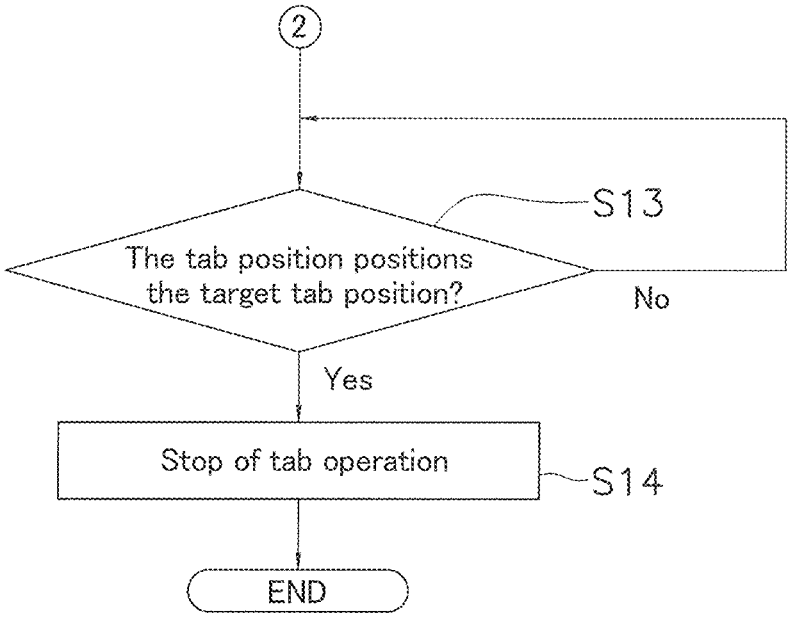
FIG. 6C is a flowchart showing processes performed by a trim tab control system.

FIGS. 6A to 6C are flowcharts showing processes performed by the trim tab control system 31. The controller 33 constantly monitors the operation state of the ship 1 (S1). For example, the controller 33 acquires operation state data, for example, at least one of the ship speed data, the attitude data, the rotation speed data, and the tab position data. In the present preferred embodiment, the controller 33 acquires the ship speed data, the attitude data, the rotation speed data, and the tab position data.

Thus, the controller 33 determines the speed of the ship 1, the attitude of the ship 1, the rotation speed of the engine 9, and the swing angle of the tab body 47. The operation state data, for example, the ship speed data, the attitude data, the rotation speed data, and the tab position data are stored in the memory 33*b* as time-series data.

The controller 33 sets the threshold based on the operation state data (S2). For example, the controller 33 sets the threshold corresponding to the operation state data (the ship speed data, the attitude data, the rotation speed data, and the tab position data) based on the second table data.

The controller 33 determines whether it is necessary to adjust the ship attitude of the ship body 3 based on the attitude data (S3). For example, the controller 33 determines whether or not the tab body 47 needs to be operated based on the attitude data. Specifically, the controller 33 determines that the controller 33 needs to operate the tab body 47 when the amount of change of at least one of the roll data, the pitch data, and the yaw data exceeds a predetermined value stored in the memory 33*b*.

When the controller 33 determines that the ship attitude of the ship body 3 needs to be adjusted (Yes in S3), the controller 33 causes the trim actuator 34 to activate based on the attitude data. Further, the controller 33 sets the target tab position of the tab body 47 based on the attitude data (S4). Further, the controller 33 sets the swing speed V of the tab body 47 to the first swing speed V1 (S5).

The controller 33 outputs an operation start signal to the trim actuator 34 so that the tab body 47 operates toward the target tab position at the first swing speed V1. Accordingly, the tab body 47 starts operating at the first swing speed V1 in the first swing direction R1 (S6). When the controller 33 determines that the ship attitude of the ship body 3 does not need to be adjusted (No in S3), the controller 33 continues the process of step 3 (S3).

In a state where the trim actuator 34 operates at the first swing speed V1, the controller 33 determines whether or not the tab body 47 is at the time of landing based on the operation state data (S7).

For example, the controller 33 determines whether the operation state data satisfies a predetermined condition. Specifically, the controller 33 determines whether or not the ship speed data, the attitude data, the rotation speed data, and the tab position data satisfy the predetermined condition respectively.

The controller 33 calculates the average value of each of the ship speed data, the attitude data, and the rotation speed data at predetermined time intervals with the time-series data of each of the ship speed data, the attitude data, and the rotation speed data. The controller 33 determines whether or not the current tab position data and the average value of each of the ship speed data, the attitude data, and the rotation speed data satisfy the predetermined condition.

The determination of whether or not the operation state data satisfies the predetermined condition, for example, the determination of whether or not the above data satisfies the predetermined condition, is performed based on the above-described landing determination data.

For example, the landing determination data includes the table data stored in the memory 33*b*. The table data indicates a correspondence relationship between the first condition data (the ship speed data, the rotation speed data, the attitude data, and the tab position data) and the flag indicating whether or not the tab body 47 is at the time of landing.

The controller 33 compares the current ship speed data, the current attitude data, the current rotation speed data, and the current tab position data with the first condition data with reference to the table data. Due to this comparison, the controller 33 determines whether or not the tab body 47 is at the time of landing.

Here, an example is shown in which the first condition data includes all of the ship speed data, the rotation speed data, the attitude data, and the tab position data. However, the first condition data is required for including at least one of the ship speed data, the rotation speed data, the attitude data, and the tab position data.

When the controller 33 determines that the operation state data does not satisfy the predetermined condition (No in S7), the controller 33 determines that the tab body 47 is not at the time of landing. In this case, the controller 33 outputs an operation signal to the trim actuator 34 so that each of the tab bodies 47 operates at the first swing speed V1. In other words, the controller 33 operates the trim actuator 34 such that the swing speed V of the tab body 47 is maintained at the first swing speed V1. Thus, the tab body 47 swings at the first swing speed V1 (S8). In this case, the controller 33 continues the process of Step 7 (S7).

When the controller 33 determines that the operation state data satisfies the predetermined condition (Yes in S7), the controller 33 determines that the tab body 47 is at time of landing. The controller 33 stores the time when the controller 33 determines that the tab body 47 is at the time of landing as the deceleration start time (ts) in the memory 33*b*.

In this case, the controller 33 outputs an operation signal to the trim actuator 34 so that each of the tab bodies 47 operates at the second swing speed V2. In other words, the controller 33 operates the trim actuator 34 so that the swing speed V of the tab body 47 becomes slower than the first swing speed V1. Thus, the tab body 47 swings at the second swing speed V2 (S9). The swing speed V of the tab body 47 is changed to the second swing speed V2 before the tab body 47 lands on the water.

Here, the second swing speed V2 is set as described above. For example, the controller 33 refers to the speed setting data (the ship speed data, the rotation speed data, the attitude data, the tab position data). The controller 33 sets the second swing speed V2 corresponding to the operation state data (the ship speed data, the rotation speed data, the attitude data, the tab position data).

The controller 33 determines whether or not the tab body 47 actually lands on the water based on the operation state data (S10). For example, whether or not the tab body 47 actually lands is determined based on the amount of change corresponding to at least one of change of the ship attitude and change of the ship speed.

Whether or not the tab body 47 actually lands is preferably determined based on the amount of change corresponding to at least one of the change of the ship attitude, the change of the ship speed, and the change of the rotation speed of the engine 9. In the present preferred embodiment, whether or not the tab body 47 actually lands is determined based on the amount of change corresponding to each of the change of the ship attitude of the ship 1, the change of the ship speed, and the change of the rotation speed of the engine 9.

For example, when the amount of change of the inclination of the ship 1 in the predetermined time is equal to or greater than a first threshold, the controller 33 determines that the tab body 47 actually lands on the water because the ship attitude is changed by the water pressure acting on the tab body 47 when the tab body 47 actually lands on the water.

Also, when the speed reduction amount of the ship 1 in the predetermined time is equal to or greater than the second threshold, the controller 33 determines that the tab body 47 actually lands on the water because the ship speed is reduced by the water pressure acting on the tab body 47 when the tab body 47 actually lands on the water.

Further, when the reduction amount of the rotation speed of the engine 9 in the predetermined time is equal to or greater than the third threshold, the controller 33 determines that the tab body 47 actually lands on the water because the rotation speed is reduced by the water pressure acting on the tab body 47 when the tab body 47 actually lands on the water.

Specifically, the controller 33 determines whether or not each of the amounts of change |K1|, |K2|, |K3| of the operation state data is less than the above threshold. It is able to be determined whether or not at least one of the amounts of change |K1|, |K2|, |K3| of the operation state data is less than the above threshold.

Here, when each of the amounts of change |K1|, |K2|, and |K3| of the operation state data is equal to or larger than the above threshold (Yes in S10), the controller 33 determines that the tab body 47 lands on the water. The time point of the determination corresponds to the landing time (to). In this case, the controller 33 executes the process of Step 11 (S11).

When the controller 33 determines that the amounts of change |K1|, |K2|, |K3| of the operation state data is less than the above threshold (No in S10), the controller 33 determines that the tab body 47 does not land on water. In this case, the controller 33 executes the process of Step 10 (S10) until the tab body 47 lands on the water.

The controller 33 determines whether or not the predetermined time (td1) has elapsed from the landing time (to) (S11). The predetermined time (td1) is stored in the memory 33*b*.

When the controller 33 determines that the predetermined time (td1) has elapsed (Yes in S11), the controller 33 outputs the operation signal to the trim actuator 34 so that each of the tab bodies 47 operates at the first swing speed V1. In other words, the controller 33 operates the trim actuator 34 such that the swing speed V of the tab body 47 returns to the first swing speed V1. Thus, the tab body 47 swings again at the first swing speed V1 after the deceleration end time (te=to+td1) in FIG. 5C (S12).

When the controller 33 determines that the predetermined time (td1) has not elapsed (No in S11), the controller 33 continues the process of step 11 (S11).

The controller 33 determines whether the tab position of the tab body 47 has positioned the target tab position (S13). For example, the controller 33 determines whether the tab position of the tab body 47 has positioned the target tab position based on the operation amount data of the trim actuator 34. The controller 33 is able to determine whether the tab position of the tab body 47 has positioned the target tab position based on the tab position data.

Here, when the controller 33 determines that the tab position of the tab body 47 has positioned the target tab position (Yes in S13), the controller 33 stops the operation of the trim actuator 34. In other words, the operation of the tab body 47 stops (S14). When the controller 33 determines that the tab position of the tab body 47 has not positioned the target tab position (No in S13), the controller 33 continues to operate the trim actuator 34 and executes the process of step (S13).

As described above, in the trim tab control system 31, the time of landing of the tab body 47 is estimated based on the operation state data. When the tab body 47 is at the time of landing, the swing speed V of the tab body 47 is changed from the first swing speed V1 to the second swing speed V2 (<first V1). Thus, the increase of lift force is reduced when the tab body 47 lands on the water. In other words, the trim tab control system 31 is capable of stably changing the ship attitude of the ship body 3 when the tab body 47 operates.

The trim tab control system 31 described above includes the following features.

In the above-described preferred embodiments, the ship speed data, the attitude data, the rotation speed data, and the tab position data are used as the operation state data in order to determine the time of landing of the tab body 47. The time of landing of the tab body 47 is able to be determined by using at least one of the ship speed data, the attitude data, the rotation speed data, and the tab position data without using all of the ship speed data, the attitude data, the rotation speed data, and the tab position data. Even if this configuration is used, the same advantageous effects as in the above-described preferred embodiments are obtained.

In the above-described preferred embodiments, examples in which the controller 33 determines the current tab position data based on the operation amount data of the trim actuator 34 have been described. Instead of this, the current tab position data may be estimated based on the ship speed data and the attitude data.

In this case, the memory 33*b* stores third table data indicating a relationship between the ship speed data and the tab position data and/or a relationship between the attitude data and the tab position data. The third table data is used to estimate the tab position data based on the ship speed data and the attitude data.

The controller 33 estimates the current tab position data based on the current ship speed data and the current attitude data. For example, the controller 33 determines the current tab position data corresponding to the current ship speed data and the current attitude data by referring to the third table data.

Even if this configuration is used, the same advantageous effects as in the above-described preferred embodiments are obtained.

In the above-described preferred embodiments, an example in which the swing speed V of the tab body 47 is returned to the first swing speed V1 in step 12 (S12) based on the landing time (to) is described.

Figure 7:
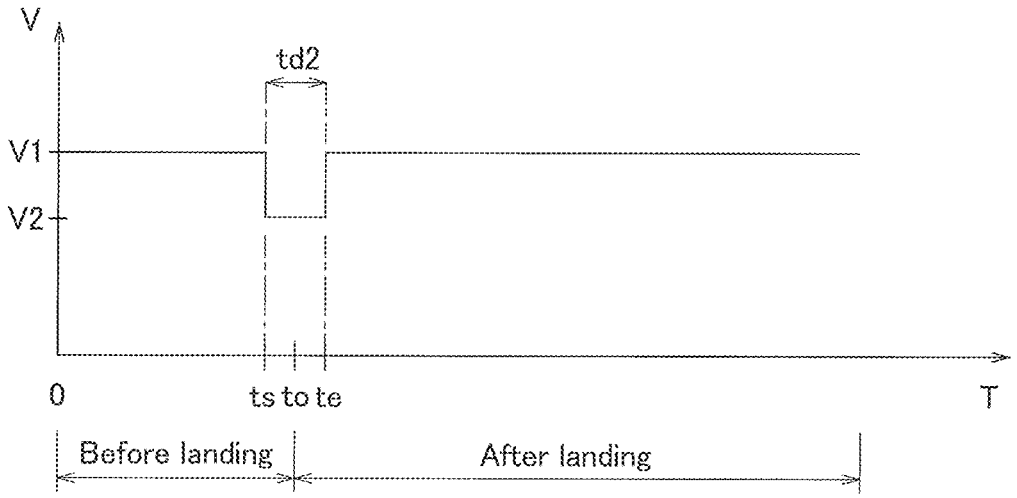
FIG. 7 is a figure for explaining the change of the operation state data at the time of landing of the tab body in a variation of a preferred embodiment of the present invention.

Instead of this, as shown in FIG. 7, after the predetermined time (td2) has elapsed with reference to the deceleration start time (ts) (when the time of landing is set), the swing speed V of the tab body 47 is returned to the first swing speed V1 in step 12 (S12).

In this case, the process of step 10 (S10) is omitted and the process of step 11 (S11) is performed. In step 11 (S11), the controller 33 determines whether or not the predetermined time (td2) has elapsed with reference to the deceleration start time (ts). Subsequent processes are the same as in the above-described preferred embodiments.

Even if this configuration is used, the same advantageous effects as in the above-described preferred embodiments are obtained.

Figure 5C:
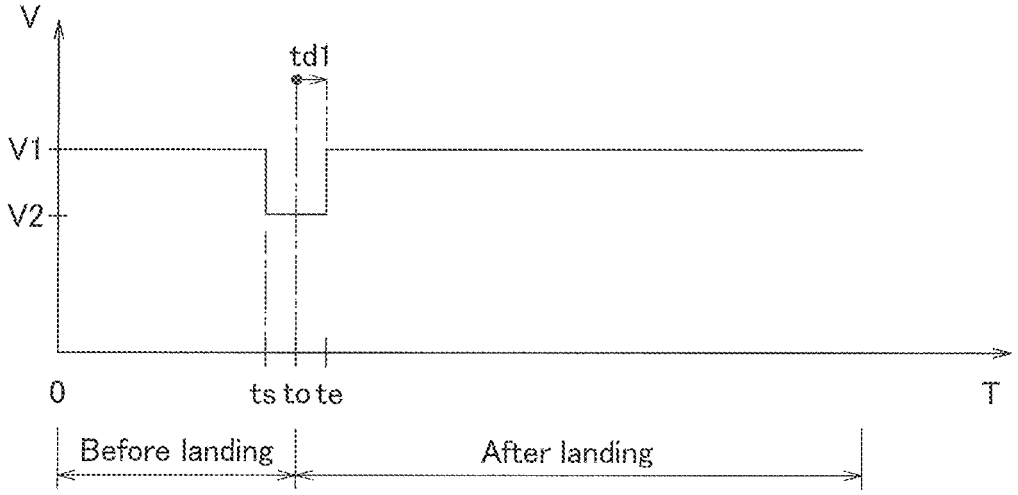
FIG. 5C is a figure for explaining a swing speed of the tab body.

In the above-described preferred embodiments, an example is shown in which the second swing speed V2 is constant as shown in FIG. 5C. Instead of this, the second swing speed V2 may be changed in a state where the second swing speed V2 is less than the first swing speed V1.

Figure 8A:
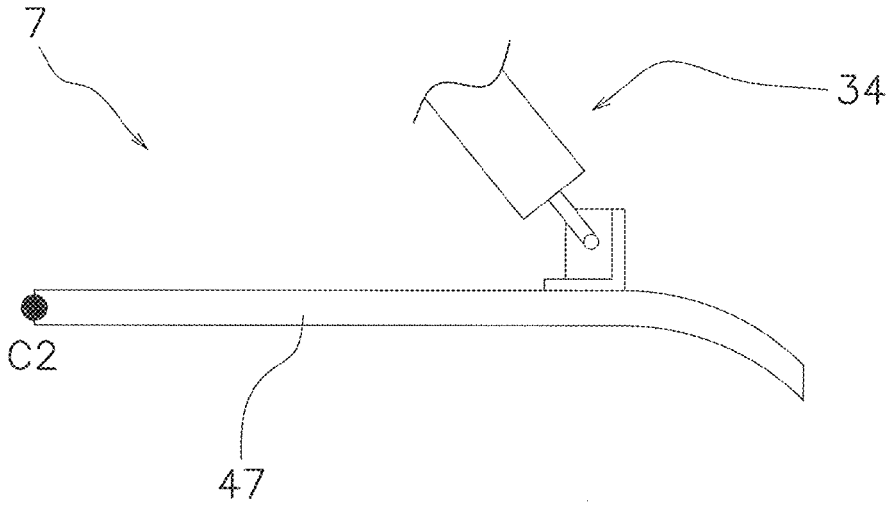
FIG. 8A is a side view of a tab body in a variation of a preferred embodiment of the present invention.
Figure 8B:
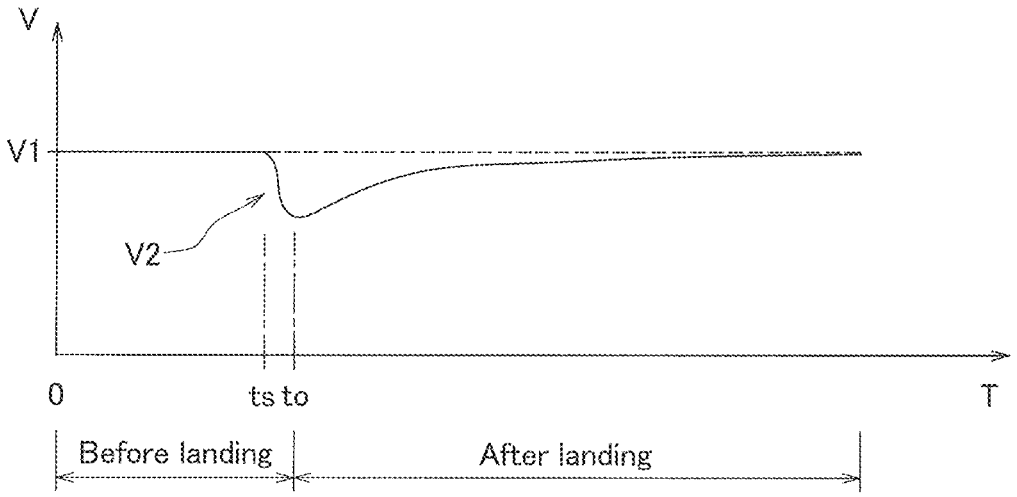
FIG. 8B is a figure for explaining the change of the operation state data at the time of landing of the tab body in a variation of a preferred embodiment of the present invention.

For example, when the tip of the tab body 47 is curved as shown in FIG. 8A, the second swing speed V2 is preferably changed as shown in FIG. 8B. In this case, the second swing speed V2 gradually decreases from the deceleration start time (ts) to the landing time (to). Thereafter, as time elapses from the landing time (to), the second swing speed V2 gradually increases toward the first swing speed V1.

The control of the second swing speed V2 is executed by the controller 33. In this case, the process of steps 10, 11, and 12 (S10, S11, S12) is omitted. In step 9 (S9), the controller 33 controls the second swing speed V2 of the tab body 47 with reference to the deceleration start time (ts) as shown in FIG. 8B.

Here, as described above, the controller 33 sets the second swing speed V2 so that the elapsed time from when the tab body 47 lands on the water and the water pressure acting on the tab body 47 are in the proportional relationship.

For example, the controller 33 sets the second swing speed V2 corresponding to the operation state data (the ship speed data, the rotation speed data, the attitude data, the tab position data) based on the speed setting data which satisfies the above proportional relationship.

Further, the controller 33 is able to control the second swing speed V2 of the tab body 47 based on the speed control function. The speed control function is stored in the memory 33*b*. In this case, the speed control function has operation state data (the ship speed data, the rotation speed data, the attitude data, the tab position data) as variables. The speed control function derives a second swing speed V2 corresponding to the variables.

Even if this configuration is used, the same advantageous effects as in the above-described preferred embodiments are obtained.

The trim tab control system 31 described above may be configured as follows.

In the above-described preferred embodiments, an example in which the swing speed V of the tab body 47 is changed to the second swing speed V2 before the tab body 47 lands on the water is described. Instead of this, the swing speed V of the tab body 47 is changed to the second swing speed V2 when the tab body 47 lands in a state where the tab body 47 swings toward the water to adjust the ship attitude of the ship body 3.

Figure 9:
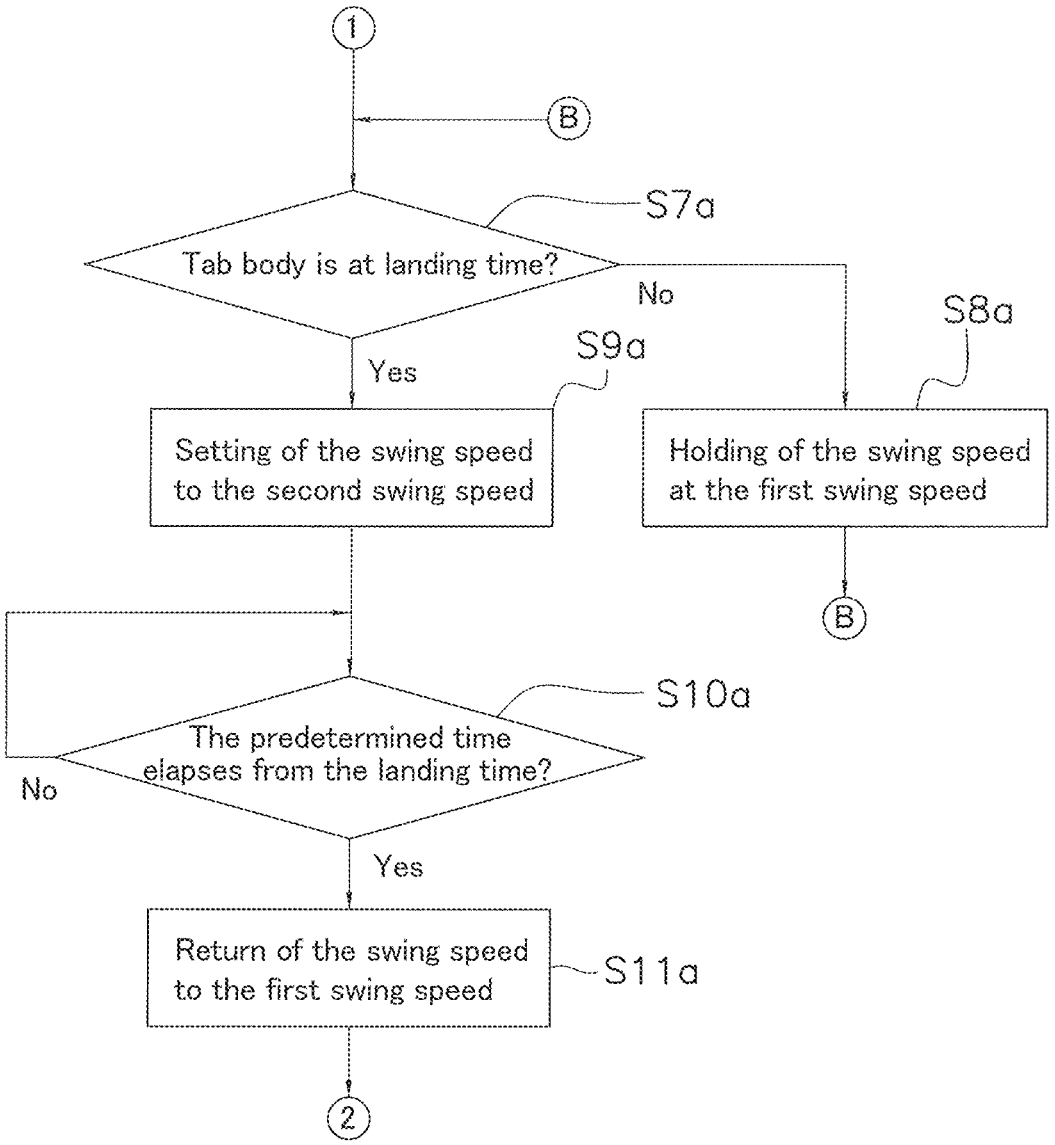
FIG. 9 is a flowchart showing processes performed by the trim tab control system according to another preferred embodiment of the present invention.

In this case, first, the controller 33 executes the process of step 1 (S1) to step 6 (S6) of the above-described preferred embodiments in the same manner as the above-described preferred embodiments (see FIG. 6A). Next, as shown in FIG. 9, the controller 33 determines whether or not the tab body 47 lands on the water based on the operation state data (S7*a*). The operation state data includes, for example, the ship speed data and the attitude data. In the present preferred embodiment, the operation state data further includes the rotation speed data.

Specifically, the controller 33 calculates the amounts of change |K1|, |K2|, |K3| of the operation state data based on the time series data of the operation state data (the ship speed data, the rotation speed data, the attitude data). The controller 33 determines whether or not the amounts of change |K1|, |K2|, |K3| of the operation state data are less than the threshold. The process of step 7*a* (S7*a*) is performed in the same manner as step 10 (S10) of the above-described preferred embodiments.

Here, when the amounts of change |K1|, |K2|, |K3| of the operation state data are less than the threshold (No in S7*a*), the controller 33 determines that the tab body 47 has not landed. In this case, the controller 33 swings the tab body 47 at the first swing speed V1 (S8*a*).

When the amounts of change |K1|, |K2|, and |K3| of the operation state data are equal to or larger than the threshold (No in S7*a*), the controller 33 determines that the tab body 47 is at the time of landing. In this case, the controller 33 swings the tab body 47 at the second swing speed V2 (S9*a*).

Subsequently, the controller 33 determines whether or not the predetermined time (td1) has elapsed from the landing time (to) (S10*a*). When the controller 33 determines that the predetermined time (td1) has elapsed (Yes in S10*a*), the controller 33 returns the swing speed V of the tab body 47 to the first swing speed V1 (S11*a*). When the controller 33 determines that the predetermined time (td1) has not elapsed (No in S10*a*), the controller 33 continues the process of Step 10*a* (S10*a*).

The process of step 10*a* (S10*a*) and step 11*a* (S11*a*) is performed in the same manner as the process of step 11 (11) and step 12 (S12) of the above-described preferred embodiments.

After the process of step 11*a* (S11*a*) is executed, the controller 33 executes the process of steps 13 (S13) to 14 (S14) of the above-described preferred embodiments in the same manner as the above-described preferred embodiments (see FIG. 6C).

Even if this configuration is used, the same advantageous effects as in the above-described preferred embodiments are obtained.

The operation state data of the above-described preferred embodiments may include strain data detected by a strain sensor 50. The strain data indicates the strain of the tab body 47. The operation state data of the above-described preferred embodiments may include load data detected by the load sensor 51. The load data indicates the load detected by the load sensor 51.

Figure 10A:
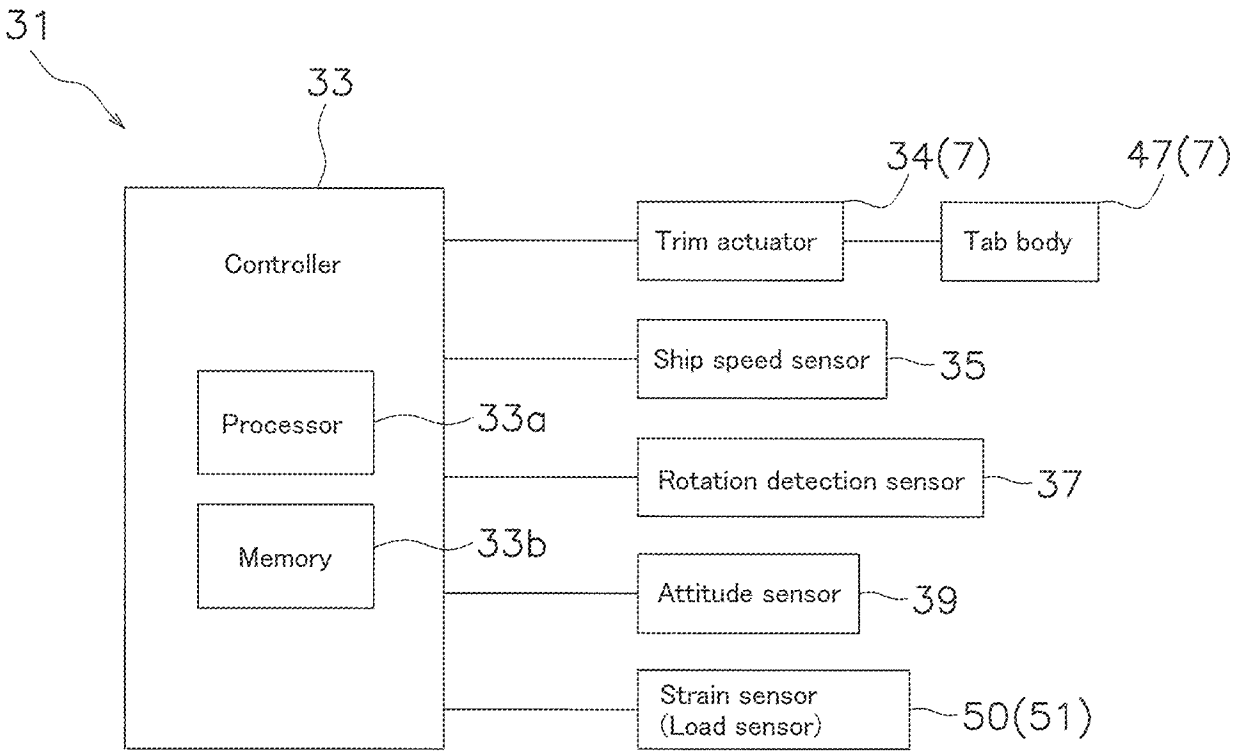
FIG. 10A is a schematic diagram showing a configuration of the trim tab control system according to another preferred embodiment of the present invention.

When the operation state data includes the strain data, as shown in FIG. 10A, the trim tab control system 31 includes the strain sensor 50 to detect the strain of the tab body 47. The strain sensor 50 is provided on the tab body 47. The strain sensor 50 includes, for example, a strain gauge. The strain sensor 50 outputs the strain data to the controller 33.

When the operation state data includes the load data, as shown in FIG. 10A, the trim tab control system 31 includes the load sensor 51 to detect a load transmitted from the trim tab 7 to the ship body 3. The load sensor 51 is disposed between the ship body 3 and the trim tab 7. Specifically, the load sensor 51 is disposed between the ship body 3 and the trim actuator 34. The load sensor 51 detects the load transmitted from the trim actuator 34 to the ship body 3. The load sensor 51 outputs the load data to the controller 33.

When the operation state data includes the strain data and/or when the operation state data includes the load data, the controller 33 determines whether the tab body 47 lands on the water based on the strain data and/or the load data in the above step 7*a* (S7*a*).

Before and after the landing of the tab body 47, the time-series data of the strain data and the load data changes such as the case of FIGS. 5A and 5B. Therefore, the controller 33 is able to determine whether or not the tab body 47 lands on the water based on the time-series data of the strain data and/or the load data.

Here, for example, the controller 33 determines whether or not the amount of change of the strain data and/or the amount of change of the load data is less than a threshold.

Each of the amounts of change is calculated in the same manner as in the above-described preferred embodiments. When the amount of change of the strain data and/or the amount of change of the load data is less than the threshold, the controller 33 determines that the tab body 47 has not landed on water. When the amount of change of the strain data and/or the amount of change of the load data is equal to or greater than the threshold, the controller 33 determines that the tab body 47 is at the time of landing.

Even if this configuration is used, the same advantageous effects as in the above-described preferred embodiments are obtained.

In the case where the trim actuator 34 of the above-described preferred embodiments is the hydraulic actuator or the electric actuator, the determination of the time of landing can be performed as follows.

Figure 10B:
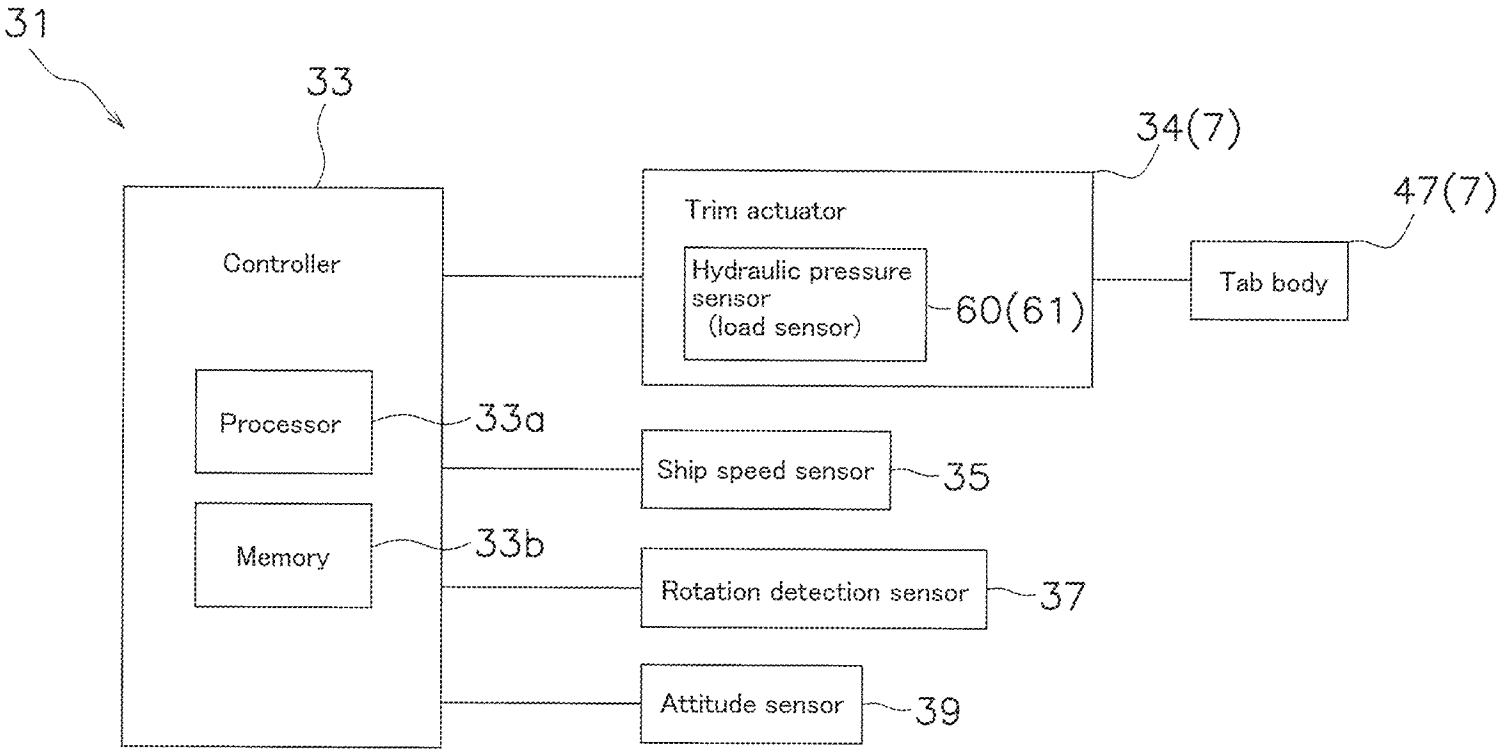
FIG. 10B is a schematic diagram showing a configuration of the trim tab control system according to another preferred embodiment of the present invention.

When the trim actuator 34 is the hydraulic actuator, as shown in FIG. 10B, the trim actuator 34 has a hydraulic pressure sensor 60 that detects the pressure of the hydraulic fluid. The operating state data includes pressure data which is detected by the hydraulic pressure sensor 60. The hydraulic pressure sensor 60 outputs the pressure data to the controller 33.

When the trim actuator 34 is the electric actuator, as shown in FIG. 10B, the trim actuator 34 includes a load sensor 61 that detects a load acting on the motor of the trim actuator 34. The operation state data includes load data which is detected by the load sensor 61. The load sensor 61 outputs the load data to the controller 33.

When the operation state data includes the pressure data and/or when the operation state data includes the load data, the controller 33 determines whether the tab body 47 is at the time of landing based on the pressure data and/or the load data in step 7*a* (S7*a*).

Before and after the landing of the tab body 47, the time series data of the pressure data and the load data changes such as the case of FIGS. 5A and 5B. Therefore, the controller 33 is able to determine whether or not the tab body 47 lands on the water based on the time-series data of the pressure data and/or the load data.

Here, for example, the controller 33 determines whether the amount of change of the pressure data and/or the amount of change of the load data is less than a threshold.

Each of the amounts of change is calculated in the same manner as in the above preferred embodiments. When the amount of change of the pressure data and/or the amount of change of the load data is less than the threshold, the controller 33 determines that the tab body 47 has not landed on water. When the amount of change of the pressure data and/or the amount of change of the load data is equal to or larger than the threshold, the controller 33 determines that the tab body 47 is at the time of landing.

Even if this configuration is used, the same advantageous effects as in the above-described preferred embodiments are obtained.

In Step 10 (S10) of the above-described preferred embodiments, an example in which the time of landing of the tab body 47 is determined based on the amount of change of the ship speed data, the amount of change of the rotation speed data, and the amount of change of the attitude data is described.

Instead of this, the determination of the landing of the tab body 47 in step 10 (S10) can be performed by using the amount of change of the strain data and/or the amount of change of the load data in (B2). Further, the determination of the landing of the tab body 47 in step 10 (S10) can be performed by using the amount of change of the pressure data and/or the amount of change of the load data in (B3).

Even if this configuration is used, the same advantageous effects as in the above-described preferred embodiments are obtained.

According to the preferred embodiments of the present invention, it is possible to stably change a ship attitude during operation of the trim tab in a trim tab control system for the ship.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A trim tab control system for a ship, the trim tab control system comprising:

a trim tab to swing on a ship body; and a controller configured or programmed to:

swing the trim tab at a first swing speed when the trim tab is not at a time of landing on water based on operation state data indicating an operation state of the ship; and swing the trim tab at a second swing speed less than the first swing speed when the trim tab is at the time of landing based on the operation state data.

2. The trim tab control system according to claim 1, wherein the controller is configured or programmed to control a moving speed of the trim tab at the second swing speed so that an elapsed time from when the trim tab lands on the water and a water pressure acting on the trim tab are in a proportional relationship.

3. The trim tab control system according to claim 2, wherein the controller is configured or programmed to control the moving speed of the trim tab at the second swing speed based on at least one of attitude data indicating a ship attitude, ship speed data indicating a ship speed, and tab position data indicating a position of the trim tab.

4. The trim tab control system according to claim 3, further comprising:

a recorder to record speed setting data indicating a correspondence relationship between the second swing speed and at least one of the attitude data, the ship speed data, and the tab position data; wherein the controller is configured or programmed to control the moving speed of the trim tab at the second swing speed based on the speed setting data.

5. The trim tab control system according to claim 1, wherein the controller is configured or programmed to acquire the time of landing based on the operation state data before the trim tab lands on the water when the trim tab swings toward the water to adjust the ship attitude.

6. The trim tab control system according to claim 5, wherein the controller is configured or programmed to swing the trim tab at the second swing speed in a predetermined time range including the time when the trim tab lands on the water.

7. The trim tab control system according to claim 5, further comprising:

an engine or a motor to apply propulsion to the ship body; wherein the operation state data includes tab position data indicating a position of the trim tab and at least one of attitude data indicating a ship attitude, ship speed data indicating a ship speed, and rotation speed data indicating a rotation speed of the engine or the motor; and the controller is configured or programmed to acquire the time of landing based on the operation state data.

8. The trim tab control system according to claim 7, wherein the operation state data further includes the first swing speed; and the controller is configured or programmed to acquire the time of landing based on the operation state data.

9. The trim tab control system according to claim 7, further comprising:

a recorder configured to record landing determination data indicating a correspondence relationship between the operation state data and the time of landing; wherein the controller is configured or programmed to acquire the time of landing based on the landing determination data.

10. The trim tab control system according to claim 5, wherein the controller is configured or programmed to return the swing speed of the trim tab to the first swing speed after a predetermined time elapses from a time when the time of landing is set.

11. The trim tab control system according to claim 1, wherein the controller is configured or programmed to determine a time when the trim tab lands on the water as the time of landing based on the operation state data when the trim tab swings toward the water to adjust an attitude of the ship.

12. The trim tab control system according to claim 11, wherein the controller is configured or programmed to swing the trim tab at the second swing speed when the trim tab lands on the water.

13. The trim tab control system according to claim 11, wherein the controller is configured or programmed to determine whether the trim tab lands on the water and to swing the trim tab at the second swing speed when the trim tab lands on the water.

14. The trim tab control system according to claim 13, wherein the controller is configured or programmed to determine whether the trim tab lands on the water based on an amount of change which corresponds to at least one of a change of the ship attitude and a change of ship speed.

15. The trim tab control system according to claim 14, wherein the controller is configured or programmed to determine that the trim tab lands on the water when the amount of change in a predetermined time range is equal to or greater than a threshold.

16. The trim tab control system according to claim 14, further comprising:

a strain sensor provided on the trim tab to detect strain on the trim tab; and the amount of change includes an amount of change of strain data detected by the strain sensor.

17. The trim tab control system according to claim 14, further comprising:

a load sensor provided between the ship body and the trim tab to detect a load transmitted from the trim tab to the ship body; and the amount of change includes an amount of change of load data detected by the load sensor.

18. The trim tab control system according to claim 14, wherein the trim tab includes a tab body and an actuator to swing the tab body with respect to the ship body;

the actuator is a hydraulic actuator and includes a pressure sensor to detect a pressure of hydraulic fluid; and the amount of change includes an amount of change of pressure data detected by the pressure sensor.

19. The trim tab control system according to claim 14, wherein the trim tab includes a tab body and an actuator to swing the tab body with respect to the ship body;

the actuator is an electric actuator and includes a load sensor to detect a load acting on a motor of the electric actuator; and the amount of change includes an amount of change of load data detected by the load sensor.

20. The trim tab control system according to claim 13, wherein the controller is configured or programmed to return the swing speed of the trim tab to the first swing speed after a predetermined time elapses from a time when the controller determines that the trim tab lands on the water.

21. A ship comprising:

the trim tab control system according to claim 1.

* * * * *